US009003827B2

(12) United States Patent
Thybo et al.

(10) Patent No.: US 9,003,827 B2
(45) Date of Patent: Apr. 14, 2015

(54) EXPANSION UNIT FOR A VAPOUR COMPRESSION SYSTEM

(75) Inventors: Claus Thybo, Soenderborg (DK); Lars Finn Sloth Larsen, Sydals (DK); Gunda Mader, Flensburg (DE)

(73) Assignee: Danfoss A/S, Nordborg (DK)

( * ) Notice: Subject to any disclaimer, the term of this patent is extended or adjusted under 35 U.S.C. 154(b) by 292 days.

(21) Appl. No.: 13/516,391

(22) PCT Filed: Dec. 16, 2010

(86) PCT No.: PCT/DK2010/000177

§ 371 (c)(1),
(2), (4) Date: Jan. 24, 2013

(87) PCT Pub. No.: WO2011/072685

PCT Pub. Date: Jun. 23, 2011

(65) Prior Publication Data

US 2013/0111946 A1 May 9, 2013

(30) Foreign Application Priority Data

Dec. 18, 2009 (DK) ..... 2009 01350

(51) Int. Cl.
*F25B 39/02* (2006.01)
*F25B 41/06* (2006.01)
*F25B 5/02* (2006.01)

(52) U.S. Cl.
CPC ..... *F25B 41/062* (2013.01); *F25B 39/028* (2013.01); *F25B 41/06* (2013.01);
(Continued)

(58) Field of Classification Search
CPC .... F25B 41/062; F25B 2341/063; F25B 1/00; F25B 39/028; F25B 41/062; G01F 7/00
USPC ..... 62/115, 222, 525, 528, 498; 137/110, 137/262, 501; 236/92 B; 251/212
See application file for complete search history.

(56) References Cited

U.S. PATENT DOCUMENTS 2,144,898 A 1/1939 Shrode
2,215,327 A 9/1940 Karsten
(Continued)

FOREIGN PATENT DOCUMENTS

DE 102007028564 A1 12/2008
EP 1975525 A1 10/2008
(Continued)

OTHER PUBLICATIONS

The International Search Report for PCT/DK2010/000177 dated Mar. 4, 2011.

*Primary Examiner* — Melvin Jones
(74) *Attorney, Agent, or Firm* — McCormick, Paulding & Huber LLP

(57) ABSTRACT

An expansion device unit (4) for a vapor compression system (1), and a vapor compression system (1) are disclosed. The expansion device unit (4) comprises an inlet opening (17) arranged to receive fluid medium, at least two outlet openings (18) arranged to deliver fluid medium, a main expanding section (6) adapted to expand fluid medium received via the inlet opening (17) before delivering the fluid medium to the outlet openings (18), and a distribution section (7) arranged to split the fluid flow received via the inlet opening (17) into at least two fluid flows to be delivered via the outlet openings (18). The main expanding section (6) and/or the distribution section (7) is/are arranged to cause pressures in fluid delivered via at least two of the outlet openings (18) to be distinct. The main expanding section (6) is operated on the basis of one or more parameters measured in the fluid flow delivered by one of the outlet openings (18). The distinct pressure levels allow distinct evaporating temperature in evaporator paths (5*a*, 5*b*, 5*c*) connected to the outlet openings (18). Thereby a large temperature difference between inlet temperature and outlet temperature of a secondary fluid flow across the evaporator (5) can be obtained, without requiring that the entire mass flow must be compressed from a low pressure level by the compressor (2). Thereby energy is conserved.

11 Claims, 8 Drawing Sheets

(52) U.S. Cl.
CPC ..... *F25B2341/0661* (2013.01); *F25B 2500/18* (2013.01); *F25B 2600/2511* (2013.01); *F25B 5/02* (2013.01)

(56) References Cited

U.S. PATENT DOCUMENTS 5,341,656 A * 8/1994 Rust et al. ..... 62/324.6
5,479,784 A * 1/1996 Dobmeier et al. ..... 62/117
2005/0198997 A1 9/2005 Bush
2010/0269527 A1 * 10/2010 Thybo et al. ..... 62/200

FOREIGN PATENT DOCUMENTS

GB 1170463 11/1969
WO 2006021071 A1 3/2006
WO 2008151630 A1 12/2008
WO 2008154919 A2 12/2008
WO 2009146704 A1 12/2009

* cited by examiner

EXPANSION UNIT FOR A VAPOUR COMPRESSION SYSTEM

CROSS REFERENCE TO RELATED APPLICATIONS

This application is entitled to the benefit of and incorporates by reference essential subject matter disclosed in International Patent Application No. PCT/DK2010/000177 filed on Dec. 16, 2010 and Danish Patent Application No. PA 2009 01350 filed Dec. 18, 2009.

FIELD OF THE INVENTION

The present invention relates to an expansion device unit for a vapour compression system, such as a refrigeration system, an air condition system or a heat pump, the vapour compression system comprising an evaporator with at least two evaporator paths. The expansion device unit of the invention is capable of delivering fluid medium to the evaporator in such a manner that the pressure of fluid medium received in one evaporator path is distinct from the pressure of fluid medium received in at least one of the other evaporator paths.

BACKGROUND OF THE INVENTION

In vapour compression systems fluid medium, such as refrigerant, is circulated along a refrigerant path wherein the components of the vapour compression system are arranged. The fluid medium is compressed in a compressor. The compressed fluid medium is then fed to a condenser, where the compressed fluid medium is condensed, the fluid medium leaving the condenser thereby being substantially in a liquid state. The fluid medium is then fed to an expansion device, where it is expanded before entering an evaporator. In the evaporator the fluid medium is evaporated before once again entering the compressor, thereby completing the cycle.

As the fluid medium is evaporated in the evaporator, heat exchange takes place between the fluid medium and a secondary fluid flow across the evaporator, thereby cooling the fluid of the secondary fluid flow. This may be used for providing refrigeration to a closed volume, such as a room or a refrigeration entity, e.g. of the kind used in supermarkets. In the case that the difference between the temperature of the incoming secondary fluid flow and the desired outlet temperature is relatively large, it is necessary to control the operation of the vapour compression system in such a manner that the evaporator temperature, and thereby the pressure in the evaporator, is very low, in order to ensure a sufficiently high refrigeration capacity. This is undesirable, since it is very energy consuming, in particular because a relatively high amount of energy is consumed by the compressor in order to compress the low pressure fluid medium leaving the evaporator.

For instance, in the case that the vapour compression system is an air condition system, the fluid of the secondary fluid flow is air which is refrigerated, due to heat exchange with the fluid medium evaporating in the evaporator, in order to reduce the temperature inside an enclosure, such as a room. In some cases it may be required to reduce the temperature of air flowing across the evaporator from approximately 26° C. to approximately 10° C. in order to obtain a desired temperature of the enclosure. In this case the evaporator temperature must be maintained below 10° C.

U.S. Pat. No. 2,215,327 discloses an air condition system comprising an evaporator with two evaporator coils arranged fluidly in parallel in the refrigerant path. The evaporator coils are further arranged in series with respect to the path of the air circulated across the evaporator. One of the evaporator coils is maintained at a higher refrigerant pressure and surface temperature than the other evaporator coil. The evaporator coil with the higher surface temperature is used for lowering the temperature of the air passing over the evaporator, and the evaporator coil with the lower temperature is used for lowering the temperature of the air passing over the evaporator as well as for lowering the humidity of the air passing over the evaporator. In order to maintain the evaporator coils at different pressures, each evaporator coil is provided with a suction pressure control valve which controls the flow of refrigerant through the corresponding evaporator coil. The valves are of the same construction, but are adjusted to maintain different refrigerant pressures in the evaporator coils.

The suction pressure control valves are arranged fluidly between the evaporator coils and a common suction line being fluidly connected to the compressor. The suction pressure control valves reduce the pressure of the refrigerant leaving the evaporator coils, and the refrigerant pressure prevailing in the common suction line is therefore lower than the refrigerant pressure of the refrigerant leaving at least one of the evaporator coils. Accordingly, the energy consumed by the compressor in order to compress the refrigerant received via the common suction line is relatively high.

Furthermore, the system comprises expansion valves arranged fluidly in front of each of the evaporator coils, and the expansion valves are provided with thermostatic elements or bulbs respectively secured to the coils adjacent the outlets thereof. Accordingly, the expansion valves are operated independently of each other.

SUMMARY OF THE INVENTION

It is an object of embodiments of the invention to provide an expansion device unit being capable of delivering at least two fluid flows at distinct pressures, on the basis of measurements performed on only one of the fluid flows.

It is a further object of embodiments of the invention to provide an expansion device unit which allows a high refrigeration capacity with a low energy consumption in a vapour compression system having the expansion device unit arranged therein.

According to the invention there is provided an expansion device unit for a vapour compression system, the expansion device unit comprising:

- an inlet opening arranged to receive fluid medium,
- at least two outlet openings arranged to deliver fluid medium,
- a main expanding section adapted to expand fluid medium received via the inlet opening before delivering the fluid medium to the outlet openings, and
- a distribution section arranged to split the fluid flow received via the inlet opening into at least two fluid flows to be delivered via the outlet openings, wherein the main expanding section and/or the distribution section is/are arranged to cause pressures in fluid delivered via at least two of the outlet openings to be distinct, and wherein the main expanding section is operated on the basis of one or more parameters measured in the fluid flow delivered by one of the outlet openings.

In the present context the term 'vapour compression system' should be interpreted to mean any system in which a flow of fluid medium, such as refrigerant, circulates and is alternatingly compressed and expanded, thereby providing either refrigeration or heating of a volume. Thus, the vapour compression system may be a refrigeration system, an air condition system, a heat pump, etc.

In the present context the term 'expansion device unit' should be interpreted to mean a part of the vapour compression system which is at least responsible for expanding fluid medium, such as refrigerant.

In the present context the term 'fluid medium' should be interpreted to mean a medium which is entirely in a liquid state, entirely in a gaseous state or in a mixed liquid and gaseous state.

The expansion device unit comprises an inlet opening and at least two outlet openings. Accordingly, during operation the expansion device unit receives a single flow of fluid medium, and at least two parallel flows of fluid are delivered from the expansion device unit. Thus, the fluid medium undergoes expansion and is divided into at least two parallel flow paths by the expansion device unit.

The expansion device unit comprises a main expanding section and a distributing section. The main expanding section is adapted to expand fluid medium received via the inlet opening before delivering the fluid medium to the outlet openings. It should be understood that expansion of the fluid medium takes part mainly or completely in the main expanding section.

The distribution section is arranged to split the fluid flow received via the inlet opening into the at least two flows of fluid which are to be delivered via the outlet openings. The distribution section may have a pure flow splitting function. As an alternative, some expansion of the fluid medium may take place in the distribution section.

The main expanding section and/or the distribution section is/are arranged to cause pressures in fluid delivered via at least two of the outlet openings to be distinct. Thus, fluid medium delivered from the expansion device unit via one outlet opening has a pressure which is significantly different from the pressure of fluid medium delivered from the expansion device unit via at least one other outlet opening. In the case that the expansion device unit is connected to an evaporator comprising at least two evaporator paths in such a manner that each outlet opening is connected to an inlet opening of an evaporator path, the fluid medium delivered to two different evaporator paths have distinct pressures. As a consequence, the evaporator temperatures in the evaporator paths will also be distinct. Thereby it is possible to allow a secondary fluid flow across the evaporator to be gradually cooled by successive evaporator paths. Thereby a desired target temperature can be reached, without requiring that all of the evaporator paths have a very low evaporator temperature. Thus, though some of the evaporator paths may have a very low temperature, this will only apply to part of the total mass flow, the remaining part of the mass flow having a higher temperature and thereby a higher suction pressure.

The main expanding section is operated on the basis of one or more parameters measured in the fluid flow delivered by one of the outlet openings. Thus, it is only necessary to arrange sensors in one of the fluid flows, and the expansion of fluid delivered by all of the outlet openings is operated on the basis of the measurements performed by these sensors. It should be noted that the one or more parameters measured in the fluid flow delivered by one of the outlet openings are not necessarily measured immediately after the fluid has been delivered from the outlet opening. It/they may alternatively be measured further downstream, e.g. after the fluid flow has passed through a separate evaporator path. However, the measurement(s) should be performed in a part of the system where the fluid flow delivered from the outlet opening is separate from the fluid flow(s) delivered from the other outlet opening(s). Thereby it is possible to obtain operation of expansion of fluid medium to all of the outlet openings using only one set of measurements, while it is still possible to keep the flow paths of fluid delivered from the outlet openings as separate flow paths. This is an advantage, since it is thereby possible to provide a vapour compression system having the expansion device unit arranged therein with separate suction lines interconnecting parallel evaporator paths directly with a compressor. Thereby some of the mass flow of fluid medium can be maintained at a relatively high pressure, and the total work to be delivered by the compressor in order to compress the fluid medium can be reduced.

Furthermore, appropriate control of expansion of fluid medium to each of the outlet openings can easily be obtained in the case that evaporator paths receiving fluid medium from the outlet openings are arranged in series along a flow direction of a secondary flow across the evaporator. In this case, when one evaporator path experiences a high load, the remaining evaporator paths will also experience a high load, and when one evaporator path experiences a low load, the remaining evaporator paths will also experience a low load. Accordingly, it is possible to estimate the load of one evaporator path on the basis of one or more control parameters related to one of the other evaporator paths, and appropriate control of expansion of fluid medium to all of the outlet openings can therefore be obtained on the basis of a single measurement.

The main expanding section may be fluidly connected between the inlet opening and the distribution section. According to this embodiment, the fluid flow received via the inlet opening is expanded by the main expanding section before it is divided into a number of parallel flow paths by the distribution section.

The distribution section may, in this case, comprise a number of parallel flow paths, each flow path being fluidly connected to an outlet opening, and at least one of the flow paths may have a flow restrictor arranged therein. A flow restrictor introduces a pressure drop in the fluid flow, and the pressure drop depends on the size of the flow restrictor. Thus, according to this embodiment, the fluid medium is initially expanded to a common pressure level by the main expanding section. The fluid flow is then divided into at least two parallel flow paths by the distribution section, and the fluid medium flowing in the parallel flow path(s) having a flow restrictor arranged therein undergo a further pressure drop, and thereby the pressure of fluid medium delivered via an outlet opening connected to a flow path with a flow restrictor is distinct from the pressure of fluid medium delivered via an outlet opening connected to a flow path which does not have a flow restrictor arranged therein. Thus, according to this embodiment, the distinct pressure levels are provided by the distribution section.

Alternatively, the distribution section may be fluidly connected between the inlet opening and the main expanding section. According to this embodiment, the fluid medium received via the inlet opening is initially divided into a number of parallel flow paths. Subsequently, the fluid medium is expanded separately in the parallel flow paths.

The main expanding section may, in this case, comprise a number of thermostatic expansion valves, the number of thermostatic expansion valves corresponding to the number of outlet openings. According to this embodiment, each of the parallel flow paths is provided with a separate thermostatic expansion valve. The expansion valves are designed to provide distinct pressure levels in at least two of the fluid flows. Thus, according to this embodiment, the distinct pressure levels are at least partly provided by the main expanding section. Furthermore, all of the expansion valves are controlled simultaneously and in dependence of each other in response to one or more parameters measured in the fluid flow delivered by one of the outlet openings.

The main expanding section may comprise an inner cylinder and an outer cylinder, the inner cylinder being arranged movably inside the outer cylinder and coaxially with the outer cylinder, the outer cylinder and the inner cylinder each being provided with a set of openings, wherein the mutual position of the set of openings of the inner cylinder and the set of openings of the outer cylinder determines the fluid flows towards the outlet openings.

According to this embodiment, the 'opening degree' of each of the flow paths through the cylinder device towards the outlet openings are controlled simultaneously by performing relative movements between the inner cylinder and the outer cylinder. Accordingly, such a main expanding section can very easily be operated on the basis of one or more parameters measured in the fluid flow delivered by one of the outlet openings, while ensuring that distinct pressure levels are obtained in the fluid flows delivered by the outlet openings. The relative movements between the inner cylinder and the outer cylinder may be rotational movements about the common axis and/or axial movements along the common axis. By selecting openings of various size, it can be obtained that the pressure levels in the fluid medium delivered from the outlet openings are distinct.

As an alternative, the main expanding section may comprise two disks being arranged movably with respect to each other, and each disk being provided with a set of openings. According to this embodiment, the two disks may be arranged rotatably with respect to each other in such a manner that the sizes of overlaps between the openings in one disk and corresponding openings in the other disk depend on the mutual rotational position of the disks. As an alternative, one disk may be provided with a set of openings, each of the openings being fluidly connected to an outlet opening, and the other disk may be provided with a set of valve elements, each being arranged to cooperate with a specific opening in the first disk to determine an 'opening degree' towards a given outlet opening. The fluid flow towards each of the outlet openings can thereby be controlled simultaneously an in dependence of each other by performing relative axial movements of the disks, i.e. moving the disks towards and away from each other, thereby simultaneously moving the openings and the valve elements relative to each other. In any event, by providing openings of various sizes, it can be obtained that the pressure levels of fluid medium delivered by the outlet openings are distinct.

As another alternative, the main expanding section and the distribution section may form an integral part. According to this embodiment, the fluid medium received via the inlet opening is simultaneously expanded and divided into a number of parallel flow paths, each flow path being connected to an outlet opening.

The main expanding section may comprise at least one thermostatic expansion valve. As an alternative, the main expanding section may be or comprise an orifice, a capillary tube or any other suitable kind of expansion device.

The invention further provides a vapour compression system comprising a compressor, a condenser, an expansion device unit according to the invention, and an evaporator comprising at least two evaporator paths arranged fluidly in parallel, wherein each of the outlet openings of the expansion device unit is fluidly connected to an evaporator path of the evaporator.

According to this aspect of the invention, the expansion device unit delivers fluid medium, such as refrigerant, to the at least two parallel evaporator paths of the evaporator.

The vapour compression system may be a refrigeration system, such as an air condition system or a heat pump.

According to one embodiment, each of the evaporator paths may be fluidly connected to the compressor via a separate suction line. This allows the distinct pressure levels of the separate flow paths to be maintained until the fluid medium is compressed in the compressor. Thereby a large temperature difference between an inlet temperature and an outlet temperature of a secondary fluid flow across the evaporator can be obtained, without requiring that the entire mass flow of fluid medium is compressed from a low pressure level in the compressor. Thereby the energy consumption of the compressor can be reduced.

BRIEF DESCRIPTION OF THE DRAWINGS

The invention will now be described in further detail with reference to the accompanying drawings in which.

DETAILED DESCRIPTION OF THE PREFERRED EMBODIMENTS

Figure 1:
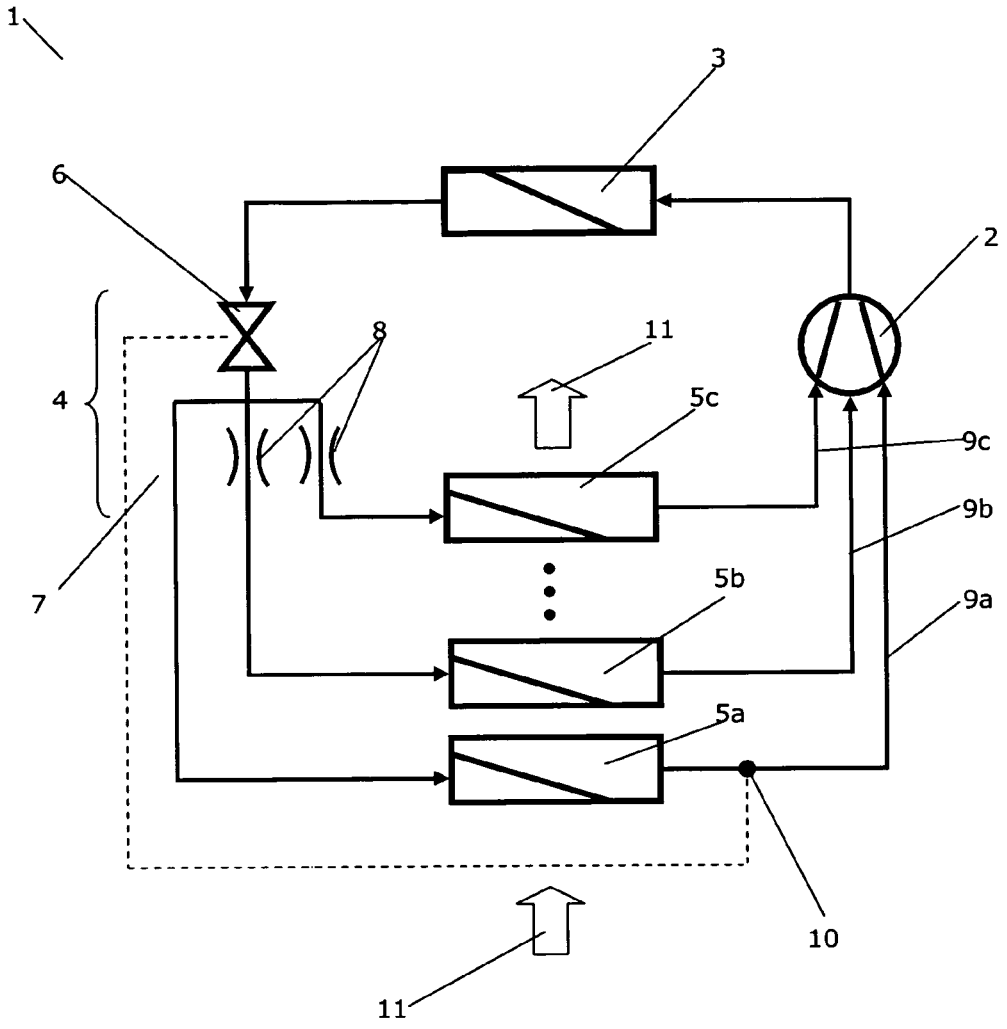
FIG. 1 is a schematic view of a vapour compression system comprising an expansion device unit according to a first aspect of the invention.

FIG. 1 is a schematic view of a vapour compression system 1 comprising a compressor 2, a condenser 3, and expansion device unit 4 according to a first embodiment of the invention, and an evaporator 5, arranged along a refrigerant path. The evaporator 5 comprises a number of evaporator paths 5*a*, 5*b*, 5*c*, three of which are shown, arranged fluidly in parallel in the refrigerant path.

The expansion device unit 4 comprises an expansion valve 6 and a distributor 7. The distributor 7 splits a fluid flow received from the expansion valve 6 into a number of parallel fluid flows, three of which are shown, each fluid flow being supplied to an evaporator path 5*a*, 5*b*, 5*c*. Two of the shown parallel flow paths of the distributor 7 have a flow restrictor 8 arranged therein. Thereby the mass flow delivered to evaporator path 5*a* is larger than the mass flows delivered to evaporator paths 5*b* and 5*c*. It should be noted that the flow restrictors 8 may not be identical, and that the mass flow delivered to evaporator path 5*b* may therefore differ from the mass flow delivered to evaporator path 5*c*.

Each of the evaporator paths 5*a*, 5*b*, 5*c* is fluidly connected directly to the compressor 2 via a separate suction line 9*a*, 9*b*, 9*c*.

The expansion valve 6 is controlled on the basis of measurements performed in the fluid flowing in suction line 9*a* by means of sensor 10. The sensor 10 may advantageously measure one or more parameters being indicative of the superheat of the fluid flowing in suction line 9*a*, and it may, e.g., be or comprise a thermostatic element or a bulb.

The vapour compression system 1 of FIG. 1 may be operated in the following manner. Fluid medium is compressed in the compressor 2, and the compressed fluid medium is delivered to the condenser 3 where it is condensed. The fluid medium leaving the condenser 3 is thereby substantially in a liquid form. The condensed fluid medium then enters the expansion valve 6 where it is expanded before being split into the parallel flow paths in the distributor 7. The expansion of the fluid medium in the expansion valve 6 results in a relatively large pressure drop in the fluid medium, and the expansion valve 6 may therefore be regarded as a 'main expanding section' of the expansion device unit 4. The flow restrictors 8 introduce a further pressure drop in the part of the fluid flow which is delivered to evaporator paths 5*b* and 5*c*. Thus, the pressure in the fluid medium delivered to evaporator path 5*a* is distinct from the pressure in the fluid medium delivered to evaporator path 5*b*, which may also be distinct from the pressure in the fluid medium delivered to evaporator path 5*c*.

The fluid medium is then evaporated in the evaporator paths 5*a*, 5*b*, 5*c*. Since the pressure of the fluid medium delivered to one evaporator path 5*a*, 5*b*, 5*c* is distinct from the pressure of the fluid medium delivered to at least one of the other evaporator paths 5*a*, 5*b*, 5*c*, the evaporating temperatures of the evaporator paths are also distinct, and the suction pressures in the suction lines 9*a*, 9*b*, 9*c* are consequently also distinct. Accordingly, the pressures in the parallel flow paths are distinct throughout the entire path from the distributor 7 to the compressor 2. This allows the evaporator temperature of evaporator path 5*a* to be higher than the evaporator temperature of evaporator path 5*b*, which is higher than the evaporator temperature of evaporator path 5*c*. Thereby a secondary air flow across the evaporator 5, illustrated by arrows 11, can be gradually cooled by heat exchange with the evaporator 5.

Figure 2:
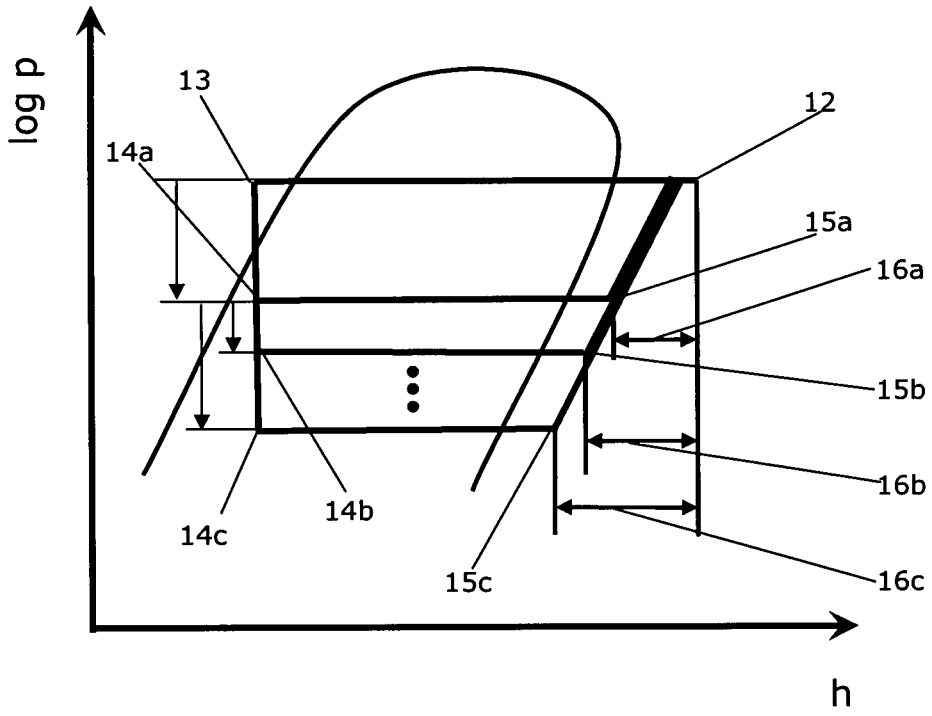
FIG. 2 is a pressure-enthalpy diagram illustrating the operation of the vapour compression system of FIG. 1.

FIG. 2 is a pressure-enthalpy (log(p)-h) diagram illustrating variations in pressure and enthalpy of the fluid medium during operation of the vapour compression system 1 of FIG. 1. From point 12 to point 13 the fluid medium is condensed in the condenser 3. The pressure remains constant while the enthalpy decreases. The fluid medium leaving the condenser 3 defines a positive subcooling.

From point 13 to point 14*a* the fluid medium is expanded in the expansion valve 6. The pressure is decreased while the enthalpy remains constant. The pressure level at point 14*a* can be regarded as a common intermediate pressure level which is reached by the entire fluid flow when passing through the expansion valve 6. Furthermore, the pressure level at point 14*a* is the pressure level of the fluid medium which is supplied to evaporator path 5*a*.

From point 14*a* to point 14*b* a part of the fluid medium passes through flow restrictor 8 in the flow path leading to evaporator path 5*b*. When the fluid medium passes through the flow restrictor, an additional pressure drop is introduced, and the pressure level at point 14*b* is therefore lower than the pressure level at point 14*a*. Accordingly, the pressure of the fluid medium supplied to evaporator path 5*b* is lower than the pressure of the fluid medium supplied to evaporator path 5*a*.

Similarly, from point 14*a* to point 14*c* a part of the fluid medium passes through flow restrictor 8 in the flow path leading to evaporator path 5*c*. As described above, this introduces an additional pressure drop in the fluid medium. It is clear from FIG. 2 that the pressure drop introduced from point 14*a* to point 14*c* is larger than the pressure drop introduced from point 14*a* to point 14*b*. As a consequence, the pressure of the fluid medium supplied to evaporator path 5*c* is lower than the pressure of the fluid medium supplied to evaporator path 5*b*.

From point 14*a* to point 15*a* fluid medium passes through evaporator path 5*a*, from point 14*b* to point 15*b* fluid medium passes through evaporator path 5*b*, and from point 14*c* to point 15*c* fluid medium passes through evaporator path 5*c*. It is clear that the pressure levels in the three evaporator paths 5*a*, 5*b*, 5*c* are distinct. It is also clear that the enthalpy of fluid medium leaving evaporator path 5*a* is higher than the enthalpy of fluid medium leaving evaporator path 5*b*, which is in turn higher than the enthalpy of fluid medium leaving evaporator path 5*c*.

From point 15*a* to point 12 fluid medium which is supplied to the compressor 2 via suction line 9*a* is compressed by the compressor 2. Similarly, from point 15*b* to point 12 fluid medium which is supplied to the compressor 2 via suction line 9*b* is compressed by the compressor 2, and from point 15*c* to point 12 fluid medium which is supplied to the compressor 2 via suction line 9*c* is compressed by the compressor 2. The enthalpy increase for each of these compressing steps is indicated by arrows 16*a*, 16*b* and 16*c*, respectively. It is clear from FIG. 2 that the enthalpy increase 16*a* is significantly smaller than the enthalpy increase 16*b*, which is in turn significantly smaller than the enthalpy increase 16*c*. Accordingly, for the part of the mass flow which flows through evaporator path 5*a* and suction line 9*a*, a relatively small enthalpy increase is required. Furthermore, only a small part of the mass flow, i.e. the part of the mass flow which passes through evaporator path 5*c* and suction line 9*c*, requires a large enthalpy increase. Since the work performed by the compressor 2 is the product of enthalpy increase and mass flow, the total work to be performed by the compressor 2 is therefore reduced as compared to a situation where the entire mass flow requires a large enthalpy increase. Thereby energy consumption of the compressor 2 is reduced.

Figure 3:
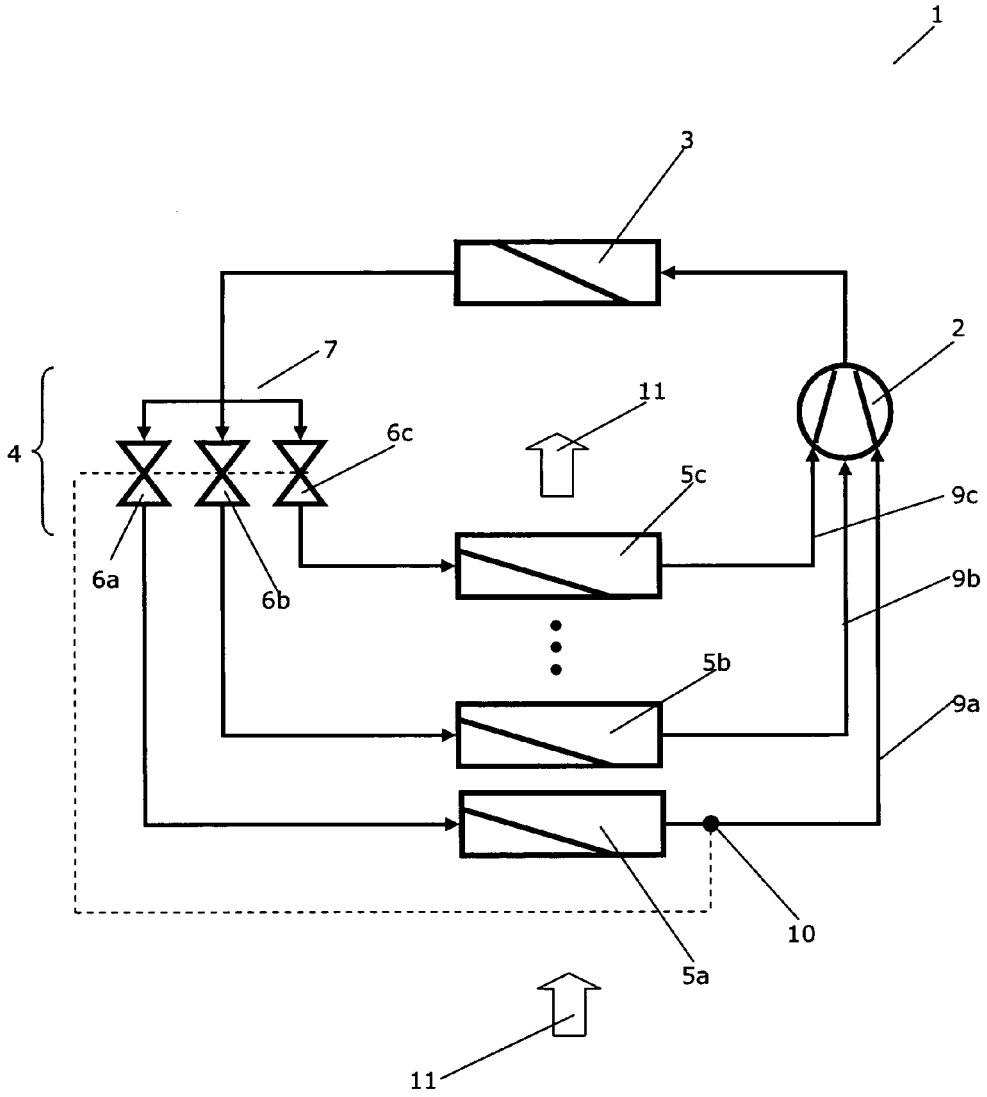
FIG. 3 is a schematic view of a vapour compression system comprising an expansion device unit according to a second aspect of the invention.

FIG. 3 is a schematic view of a vapour compression system 1 comprising a compressor 2, a condenser 3, and expansion device unit 4 according to a second embodiment of the invention, and an evaporator 5, arranged along a refrigerant path. The evaporator 5 comprises a number of evaporator paths 5*a*, 5*b*, 5*c*, three of which are shown, arranged fluidly in parallel in the refrigerant path. The vapour compression system 1 of FIG. 3 is very similar to the vapour compression system 1 of FIG. 1, and it is therefore not described in further detail here.

In the embodiment of FIG. 3 the expansion device unit 4 comprises a distributor section 7 and a number of expansion valves 6*a*, 6*b*, 6*c*, three of which are shown. Each expansion valve 6*a*, 6*b*, 6*c* is fluidly connected to an inlet opening of an evaporator path 5*a*, 5*b*, 5*c*. The distributor 7 is arranged fluidly between the condenser 3 and the expansion valves 6*a*, 6*b*, 6*c*. Thus, the fluid flow is divided into a number of parallel fluid flows by the distributor 7, and each fluid flow is passed through a separate expansion valve 6*a*, 6*b*, 6*c* before entering a respective evaporator path 5*a*, 5*b*, 5*c*. By selecting the expansion valves 6*a*, 6*b*, 6*c* in an appropriate manner it can thereby be obtained that the pressure levels of the fluid medium supplied to the evaporator paths 5*a*, 5*b*, 5*c* are distinct.

Each of the evaporator paths 5*a*, 5*b*, 5*c* is fluidly connected to the compressor 2 via a separate suction line 9*a*, 9*b*, 9*c* as it is the case in the vapour compression system 1 of FIG. 1. The expansion valves 6*a*, 6*b*, 6*c* are controlled simultaneously and in a mutually dependent manner on the basis of measurements performed in one of the suction lines 9*a* by means of sensor 10. The sensor 10 may advantageously measure one or more parameters being indicative of the superheat of the fluid flowing in suction line 9*a*, and it may, e.g., be or comprise a thermostatic element or a bulb.

The expansion valves 6*a*, 6*b*, 6*c* constitute 'flow restrictions' in the respective flow paths, the size of each flow restriction depending on the opening degree of the expansion valve 6*a*, 6*b*, 6*c*. The simultaneous and mutually dependent operation of the expansion valves 6*a*, 6*b*, 6*c* ensures that the expansion valves 6*a*, 6*b*, 6*c* are operated in such a manner that a predetermined ratio in 'flow restriction' among the expansion valves 6*a*, 6*b*, 6*c* is obtained. The ratio may advantageously be selected in a manner which follows a load pattern which is determined by the evaporator paths 5*a*, 5*b*, 5*c*.

As mentioned above, the separate expansion valves 6*a*, 6*b*, 6*c* allow the fluid medium to be expanded to different pressure levels. The expansion valves 6*a*, 6*b*, 6*c* may be operated in such a manner that a predetermined ratio of the pressure levels is maintained. However, the ratio of the pressure levels may alternatively be allowed to vary, and the expansion valves 6*a*, 6*b*, 6*c* may instead be operated to obtain a predetermined ratio of 'flow restriction', opening degree or another relevant parameter.

In the expansion device unit 4 shown in FIG. 3 no expansion of the fluid medium takes place in the distributor 7. Accordingly, the entire expansion takes place in the expansion valves 6*a*, 6*b*, 6*c*, and the expansion valves 6*a*, 6*b*, 6*c* may therefore be regarded as a 'main expanding section' of the expansion device unit 4.

Figure 4:
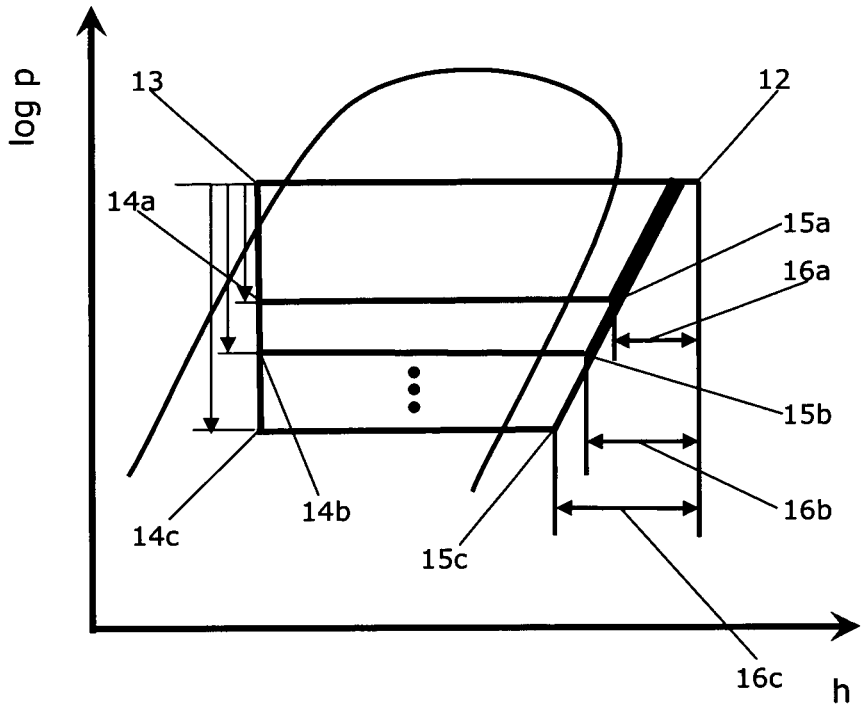
FIG. 4 is a pressure-enthalpy diagram illustrating the operation of the vapour compression system of FIG. 3.

FIG. 4 is a pressure-enthalpy (log(p)-h) diagram illustrating variations in pressure and enthalpy of the fluid medium during operation of the vapour compression system 1 of FIG. 3. The diagram of FIG. 4 and the operation of the vapour compression system 1 of FIG. 3 are very similar to the diagram of FIG. 2 and the operation of the vapour compression system 1 of FIG. 1, respectively. The diagram of FIG. 4 is therefore not described in detail here.

In FIG. 4, point 13 represents the position where the fluid medium leaves the distributor 7 and is led towards the expansion valves 6*a*, 6*b*, 6*c*. From point 13 to point 14*a*, some of the fluid medium is expanded in expansion valve 6*a*. Similarly, from point 13 to point 14*b*, some of the fluid medium is expanded in expansion valve 6*b*, and from point 13 to point 14*c*, some of the fluid medium is expanded in expansion valve 6*c*. In each case the expansion of the fluid medium introduces a pressure drop in the fluid medium. From FIG. 4 it is clear that the pressure levels reached by fluid medium being expanded in the expansions valves 6*a*, 6*b*, 6*c* differ from each other. Thus, the pressure level of fluid medium having been expanded by expansion valve 6*a* and entering evaporator path 5*a* is significantly higher than the pressure level of fluid medium having been expanded by expansion valve 6*b* and entering evaporator path 5*b*. Furthermore, the pressure level of fluid medium having been expanded by expansion valve 6*b* and entering evaporator path 5*b* is significantly higher than the pressure level of fluid medium having been expanded by expansion valve 6*c* and entering evaporator path 5*c*.

From point 14*a* to point 15*a* fluid medium passes through evaporator path 5*a*, from point 14*b* to point 15*b* fluid medium passes through evaporator path 5*b*, and from point 14*c* to point 15*c* fluid medium passes through evaporator path 5*c*. It is clear that the pressure levels in the three evaporator paths 5*a*, 5*b*, 5*c* are distinct. It is also clear that the enthalpy of fluid medium leaving evaporator path 5*a* is higher than the enthalpy of fluid medium leaving evaporator path 5*b*, which is in turn higher than the enthalpy of fluid medium leaving evaporator path 5*c*.

Similarly to the situation described above with reference to FIG. 2, from points 15*a*, 15*b* and 15*c* to point 12 fluid medium which is supplied to the compressor 2 via suction lines 9*a*, 9*b* and 9*c*, respectively, is compressed by the compressor 2. It is clear from FIG. 4 that the enthalpy increase 16*a* is significantly smaller than the enthalpy increase 16*b*, which is in turn significantly smaller than the enthalpy increase 16*c*. Accordingly, energy consumption of the compressor 2 is reduced as described above.

It is an advantage of the embodiment illustrated in FIGS. 1 and 2, as well as of the embodiment illustrated in FIGS. 3 and 4 that the fluid medium is expanded to different pressure levels in the expansion device unit 4, since this allows the pressure levels to be kept at distinct levels during evaporation and in the suction lines 9*a*, 9*b*, 9*c*. This allows for different evaporator temperatures in the evaporator paths 5*a*, 5*b*, 5*c*, allowing a large cooling capacity of the evaporator 5 without requiring that the entire mass flow of fluid medium is compressed from a low pressure level in the compressor. Accordingly, energy is saved as described above.

Figure 5:
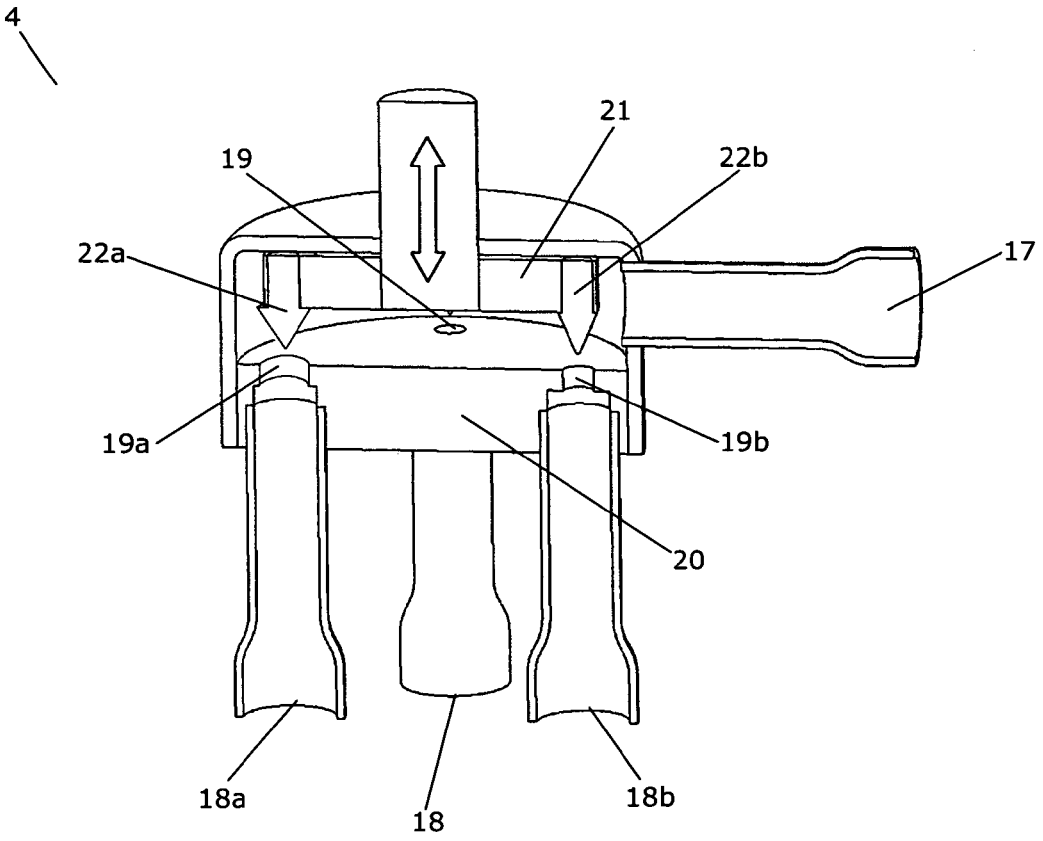
FIG. 5 is a cross sectional view of an expansion device unit according to a first embodiment of the invention.

FIG. 5 is a cross sectional view of an expansion device unit 4 according to a first embodiment of the invention. The expansion device unit 4 comprises an inlet opening 17 and four outlet openings 18, three of which are shown. Each of the outlet openings 18 is connected to a valve opening 19 formed in a first disk 20. A second disk 21 is provided with four valve elements 22, two of which are shown. The openings 19 and the valve elements 22 are positioned in such a manner that four valves are formed by corresponding sets of openings 19 and valve elements 22. The second disk 21 is mounted movably relative to the first disk 20. Thereby all of the valve elements 22 can be moved simultaneously and in dependence of each other relative to their respective openings 19 by moving the second disk 21 relative to the first disk 20, and the opening degree of each of the 'valves' is thereby controlled.

The opening 19*a* is larger than the opening 19*b*. Therefore, at a given relative position of the first disk 20 and the second disk 21, the flow passage at opening 19*a* is larger than the flow passage at opening 19*b*. As a consequence, the pressure of the fluid medium leaving the expansion device unit 4 via outlet opening 18*a* is higher than the pressure of the fluid medium leaving the expansion device unit 4 via outlet opening 18*b*. Thus, in the embodiment shown in FIG. 5 the distinct pressures of the fluid medium leaving the expansion device unit 4 via the outlet openings 18 is provided by the different sizes of the openings 19.

Figure 6:
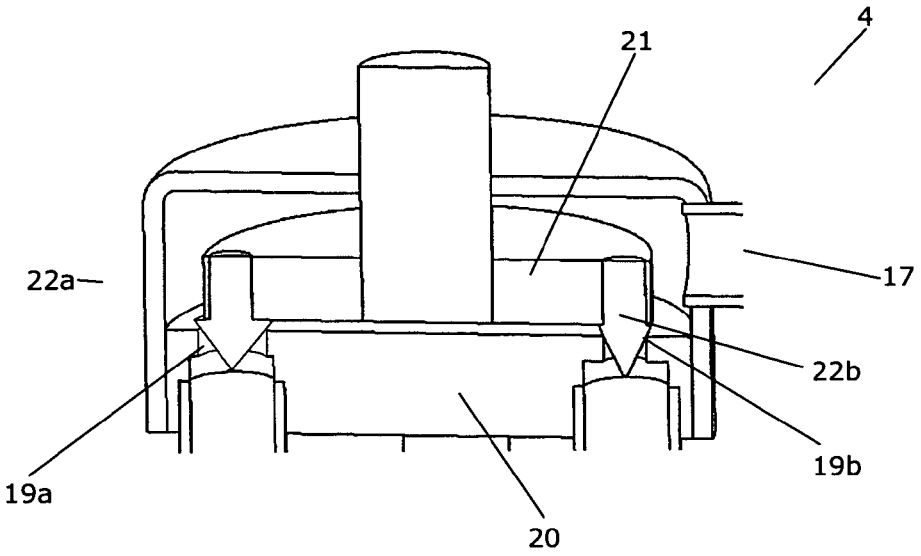
FIGS. 6-8 illustrate operation of the expansion device unit of FIG. 5, FIGS. 9 and 10 are perspective views of a set of movable disks for an expansion device unit according to a second embodiment of the invention.
Figure 7:
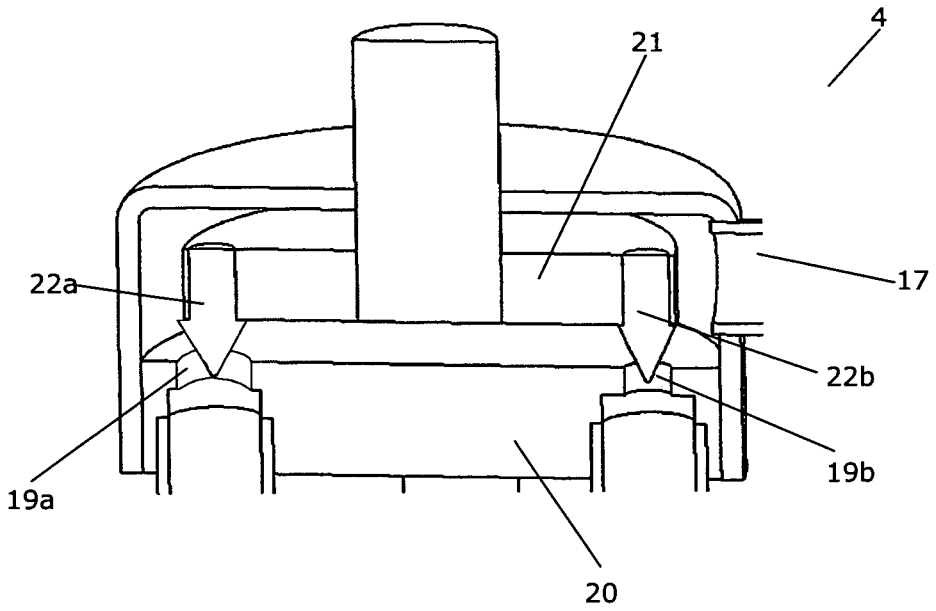
Figure 8:
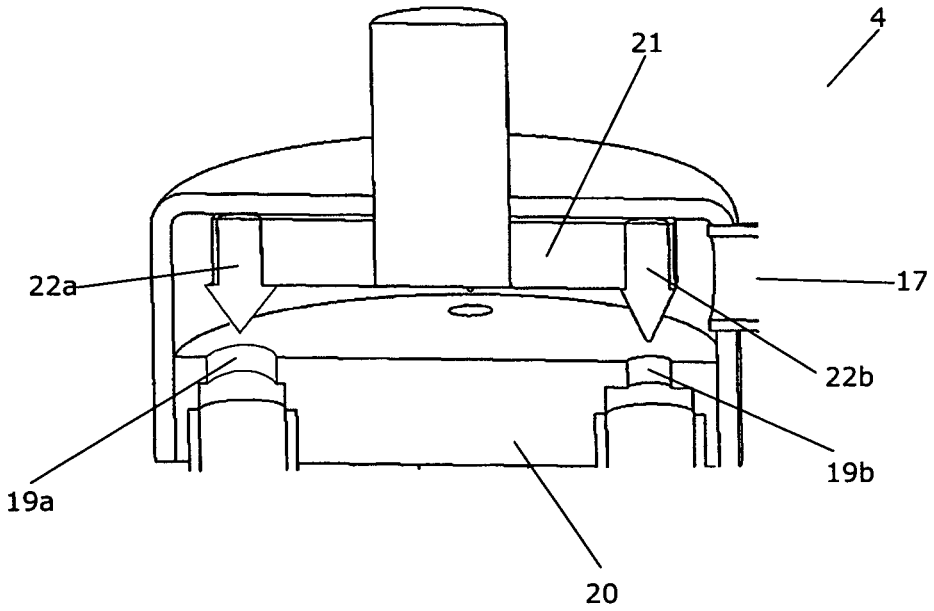

FIGS. 6-8 illustrate operation of the expansion device unit 4 of FIG. 5. In FIG. 6 the second disk 21 is positioned as close as possible to the first disk 20. Thereby the valve elements 22 are arranged relative to the openings 19 in such a manner that the valves formed by the openings 19 and the valve elements 22 are completely closed, i.e. fluid medium is not allowed to pass through the openings 19.

In FIG. 7 the second disk 21 has been moved a distance from the first disk 20, and the valves formed by the openings 19 and the valve elements 22 are therefore in a partly open state. It is clear from FIG. 7 that the fluid passage defined between opening 19*a* and valve element 22*a* is larger than the passage defined between opening 19*b* and valve element 22*b*.

In FIG. 8 the second disk 21 has been moved even further away from the first disk 20, and the valve elements 22 are arranged completely above the openings 19. Thus, the valves formed by the openings 19 and the valve elements 22 are in a fully open state, where the fluid passages defined by the openings 19 and the valve elements 22 are identical in size to the openings 19. Since the opening 19*a* is larger than the opening 19*b*, the fluid passage defined by opening 19*a* and valve element 22*a* is larger than the fluid passage defined by opening 19*b* and valve element 22*b*.

Figure 9:
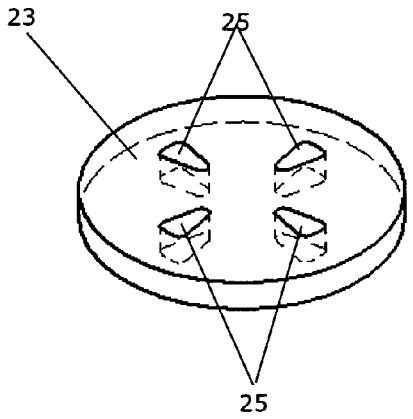
Figure 10:
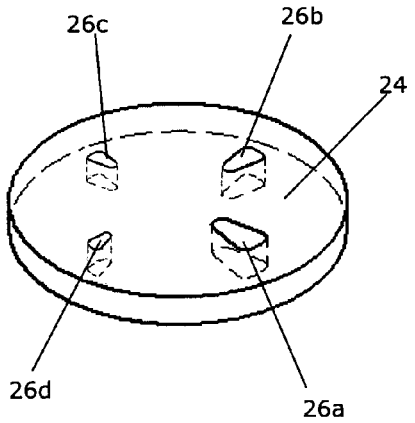

FIGS. 9 and 10 are perspective views of a set of movable disks 23, 24 for an expansion device unit according to a second embodiment of the invention. The first disk 23 is provided with four openings 25 of identical size and shape. The second disk 24 is provided with four opening 26 of different size, the opening 26*a* being larger than the opening 26*b*, which is larger than the opening 26*c*, which is larger than the opening 26*d*. Thereby, when fluid medium passes through the second disk 24, via the openings 26, different pressure levels are obtained, depending on which of the openings 26*a*, 26*b*, 26*c*, 26*d* the fluid medium passes through. When mounted in the expansion device unit the disks 23, 24 are arranged in such a manner that they can rotate relative to each other about an axis extending through the centre of each of the disks 23, 24.

FIGS. 11-14 illustrate the operation of an expansion device unit having the disks 23, 24 of FIGS. 9 and 10 arranged therein. In FIGS. 11-14 the disks 23, 24 are arranged adjacent to each other in such a manner that relative rotational movements of the disks 23, 24 are possible. The disks 23, 24 should be arranged in the expansion device unit in such a manner that fluid medium is received at one side of the disks 23, 24 and delivered at the opposite side of the disks 23, 24. Accordingly, fluid medium passes through the disks 23, 24 via the openings 25, 26.

Figure 11:
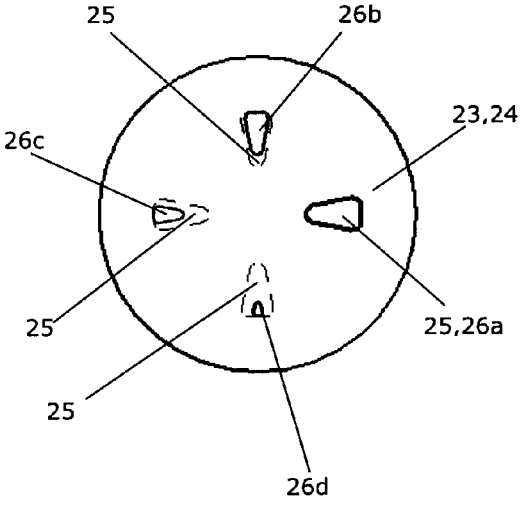
FIGS. 11-14 illustrate operation of the expansion device unit of FIGS. 9 and 10.

In FIG. 11 the disks 23, 24 are positioned relative to each other in such a manner that a maximum overlap is obtained pair-wise between the openings 25 of the first disk 23 and the openings 26 of the second disk 24. Thus, in this position the flow rate of fluid passing through the disks 23, 24, via the openings 25, 26, is maximum.

Figure 12:
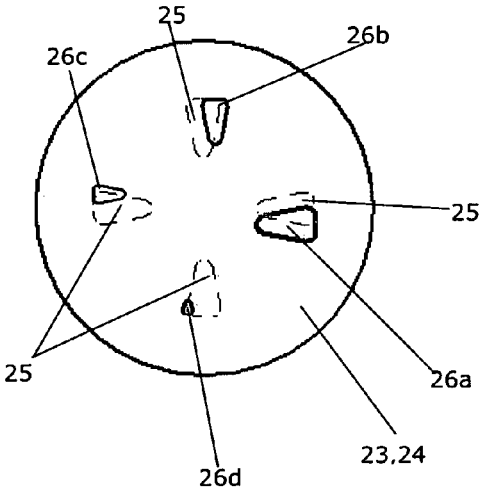

In FIG. 12 the disks 23, 24 have been rotated slightly relative to each other, and the overlaps between openings 25 of the first disk 23 and openings 26 of the second disk 24 have thereby been decreased as compared to the situation illustrated in FIG. 11. Thereby the flow rate of fluid passing through the disks 23, 24, via the openings 25, 26, has also been decreased.

Figure 13:
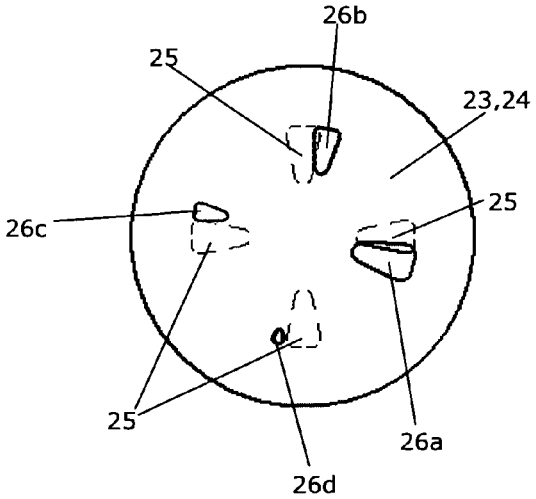

In FIG. 13 the disks 23, 24 have been rotated further relative to each other, thereby decreasing the overlaps and the flow rate even further. The openings 26*c* and 26*d* of the second disk 24 have even been moved to a position where there is no overlap between the openings 26*c*, 26*d* and the corresponding openings 25 of the first disk 23. Accordingly, no fluid medium is allowed to pass the disks 23, 24 via these openings.

Figure 14:
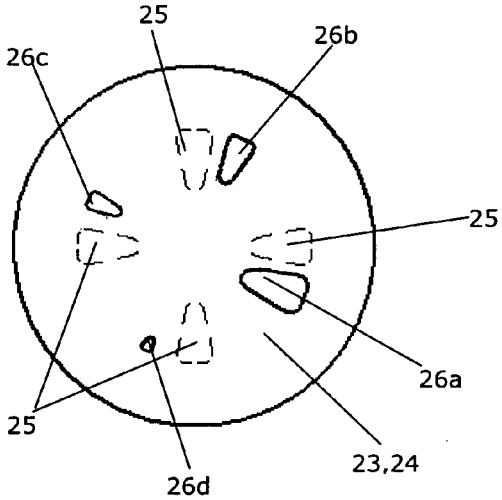

In FIG. 14 the disks 23, 24 have been rotated even further relative to each other to a position where there is no overlap between openings 25 of the first disk 23 and openings 26 of the second disk 24. Accordingly, no fluid medium is allowed to pass the disks 23, 24 via the openings 25, 26, and the expansion device unit having the disks 23, 24 arranged therein may be regarded as being in a closed state.

In the embodiment illustrated by FIGS. 9-14, the overlaps between the openings 25 of the first disk 23 and the openings 26 of the second disk 24 are changed simultaneously and in dependence of each other, since the openings 25, 26 are arranged on the disks 23, 24 which are rotated relative to each other. An expansion device unit have the disks 23, 24 arranged therein is therefore very suitable for being operated on the basis of one or more parameters obtained from measurements in a flow path of fluid leaving one of the openings 26. Furthermore, the pressure levels of the fluid medium passing through the opening 25, 26 are distinct, due to the different sizes of the openings 26*a*, 26*b*, 26*c*, 26*d*.

Figure 15:
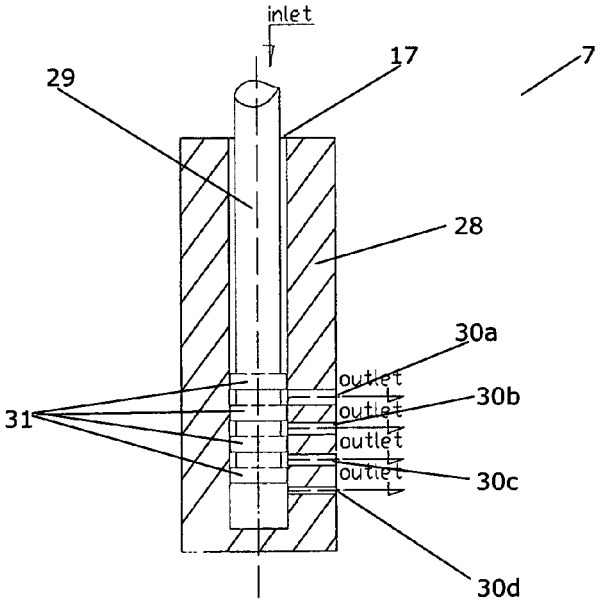
FIG. 15 is a cross sectional view of a distribution section of an expansion device unit according to a third embodiment of the invention.

FIG. 15 is a cross sectional view of a distribution section 7 of an expansion device unit according to a third embodiment of the invention. The distribution section 7 comprises an outer cylinder 28 and an inner cylinder 29 arranged inside and coaxially with the outer cylinder 28. The inner cylinder 29 is movable relative to the outer cylinder 28 along the common axis.

The outer cylinder 28 is provided with four openings 30, each being fluidly connected to an outlet opening (not shown) of the expansion device unit. The opening 30*a* is larger than the opening 30*b*, which is larger than the opening 30*c*, which is larger than the opening 30*d*. The inner cylinder 29 is provided with four regions 31 having an increased cross sectional diameter. The regions 31 having an increased cross sectional diameter can be moved to a position where a partial or complete overlap between the regions 31 and the openings 30 of the outer cylinder 28 by moving the inner cylinder 29 along an axial direction relative to the outer cylinder 28.

Fluid medium is received in the distribution section 7 at inlet opening 17 and passes between the outer cylinder 28 and the inner cylinder 29 and through the openings 30 towards the outlet openings. The overlap between the regions 31 and the openings 30 defines an opening degree for each of the flow passages towards the outlet openings. Since the respective overlaps are changed by moving the inner cylinder 29, the opening degrees are controlled simultaneously and in dependence of each other. Accordingly, this embodiment is very suitable for being controlled on the basis of a single measured control parameter.

Furthermore, the different sizes of the openings 30 causes the pressure levels of the fluid medium leaving the distribution section 7 via the openings 30 to be distinct, similarly to the situation described above with reference to FIG. 5.

Although the invention above has been described in connection with preferred embodiments of the invention, it will be evident for a person skilled in the art that several modifications are conceivable without departing from the invention as defined by the following claims.

The invention claimed is:

1. An expansion device unit for a vapour compression system, the expansion device unit comprising:

an inlet opening arranged to receive fluid medium, at least two outlet openings arranged to deliver fluid medium, a main expanding section adapted to expand fluid medium received via the inlet opening before delivering the fluid medium to the outlet openings, and a distribution section arranged to split the fluid flow received via the inlet opening into at least two fluid flows to be delivered via the outlet openings, wherein the main expanding section and/or the distribution section is/are arranged to cause pressures in fluid delivered via at least two of the outlet openings to be distinct, and wherein the main expanding section is operated based on one or more parameters measured in the fluid flow delivered by one of the outlet openings.

2. The expansion device unit according to claim 1, wherein the main expanding section is fluidly connected between the inlet opening and the distribution section.

3. The expansion device unit according to claim 2, wherein the distribution section comprises a number of parallel flow paths, each flow path being fluidly connected to an outlet opening, and wherein at least one of the flow paths has a flow restrictor arranged therein.

4. The expansion device unit according to claim 1, wherein the distribution section is fluidly connected between the inlet opening and the main expanding section.

5. The expansion device unit according to claim 4, wherein the main expanding section comprises a number of thermostatic expansion valves, the number of thermostatic expansion valves corresponding to the number of outlet openings.

6. The expansion device unit according to claim 4 or 5, wherein the main expanding section comprises an inner cylinder and an outer cylinder, the inner cylinder being arranged movably inside the outer cylinder and coaxially with the outer cylinder, the outer cylinder and the inner cylinder each being provided with a set of openings, wherein the mutual position of the set of openings of the inner cylinder and the set of openings of the outer cylinder determines the fluid flows towards the outlet openings.

7. The expansion device unit according to claim 4 or 5, wherein the main expanding section comprises two disks being arranged movable with respect to each other, and each disk being provided with a set of openings.

8. The expansion device unit according claim 1, wherein the main expanding section and the distribution section form an integral part.

9. The expansion device unit according to claim 1, wherein the main expanding section comprises at least one thermostatic expansion valve.

10. A vapour compression system comprising a compressor, a condenser, an expansion device unit according to claim 1, and an evaporator comprising at least two evaporator paths arranged fluidly in parallel, wherein each of the outlet openings of the expansion device unit is fluidly connected to an evaporator path of the evaporator.

11. The vapour compression system according to claim 10, wherein each of the evaporator paths is fluidly connected to the compressor via a separate suction line.

* * * * *